United States Patent [19]

Poirier et al.

[11] Patent Number: 5,033,431

[45] Date of Patent: Jul. 23, 1991

[54] METHOD OF LEARNING GAIN FOR THROTTLE CONTROL MOTOR

[75] Inventors: David C. Poirier, Troy; Joseph M. Tolkacz, Warren; George C. Mitchell, Ypsilanti; Robert C. Simon, Jr., Novi; Peter M. Medich, Birmingham, all of Mich.

[73] Assignee: General Motors Corporation, Detroit, Mich.

[21] Appl. No.: 546,452

[22] Filed: Jul. 2, 1990

[51] Int. Cl.[5] ..... F02D 41/00

[52] U.S. Cl. ..... 123/339; 123/361; 123/399

[58] Field of Search ..... 123/339, 361, 399

[56] References Cited

U.S. PATENT DOCUMENTS

| | | | |
|---|---|---|---|
| 4,506,642 | 3/1985 | Pfalzgraf et al. | 123/339 |
| 4,519,361 | 5/1985 | Murakami | 123/361 |
| 4,622,936 | 11/1986 | Junginger et al. | 123/361 |
| 4,773,370 | 9/1988 | Koshizawa et al. | 123/399 |

FOREIGN PATENT DOCUMENTS

| | | | |
|---|---|---|---|
| 59-158342 | 9/1984 | Japan | 123/339 |
| 60-69238 | 4/1985 | Japan | 123/399 |
| 2213961 | 8/1989 | United Kingdom | 123/339 |

*Primary Examiner*—Andrew M. Dolinar
*Attorney, Agent, or Firm*—Howard N. Conkey

[57] ABSTRACT

An idle speed control motor under computer control positions a throttle stop for setting minimum throttle angles. The motor response to actuating pulses varies from motor to motor so that a gain factor is determined for each motor and is used to calculate the required pulse width to attain a desired throttle displacement. A gain learn program in the engine control computer runs when the ignition is turned off and is effective to extend the motor with a number of pulses of known width, measure the throttle displacement, and determine the gain factor by dividing a standard displacement by the measured displacement. The same program is applied to learning the gain of a throttle motor in an electronic throttle control system.

12 Claims, 9 Drawing Sheets

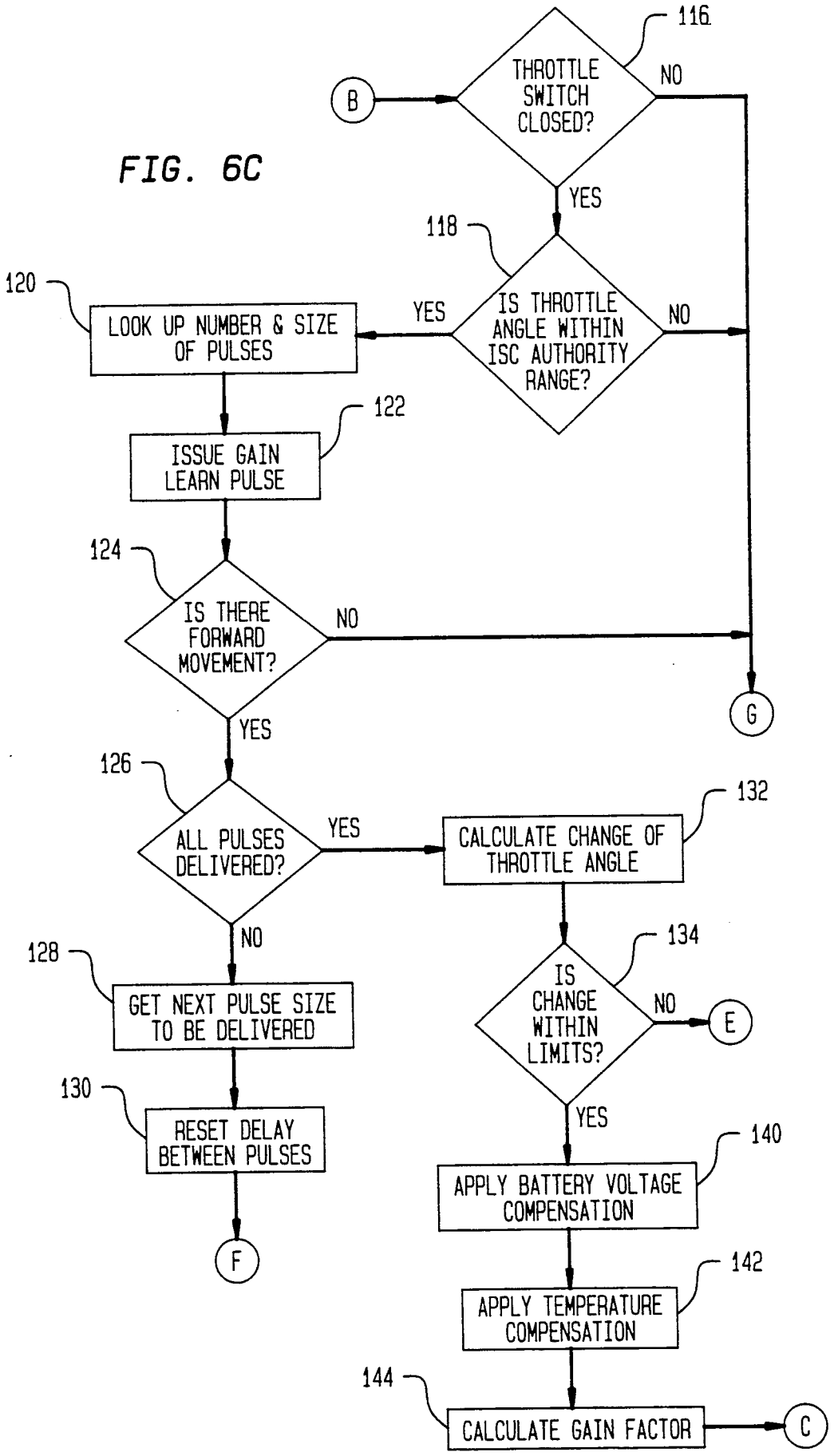
FIG. 6C
B
THROTTLE SWITCH CLOSED?
116
NO
YES
118
IS THROTTLE ANGLE WITHIN ISC AUTHORITY RANGE?
YES
NO
120
LOOK UP NUMBER & SIZE OF PULSES
122
ISSUE GAIN LEARN PULSE
124
IS THERE FORWARD MOVEMENT?
NO
G
YES
126
ALL PULSES DELIVERED?
YES
132
CALCULATE CHANGE OF THROTTLE ANGLE
NO
128
GET NEXT PULSE SIZE TO BE DELIVERED
134
IS CHANGE WITHIN LIMITS?
NO
E
130
RESET DELAY BETWEEN PULSES
YES
140
APPLY BATTERY VOLTAGE COMPENSATION
F
142
APPLY TEMPERATURE COMPENSATION
144
CALCULATE GAIN FACTOR
C

METHOD OF LEARNING GAIN FOR THROTTLE CONTROL MOTOR

FIELD OF THE INVENTION

This invention relates to a method of learning the gain of a throttle control motor installed in a motor vehicle.

BACKGROUND OF THE INVENTION

It is well known in automotive engine controls to regulate the released (typically referred to as closed) position of the throttle in the throttle bore of the engine such as by controlling the position of a movable throttle stop in order to achieve a desired engine operating condition. The most common function of such regulation is the closed loop control of engine idle speed. When controlling the engine idle speed, the throttle position and therefore air intake quantity is actively regulated in response to measured engine speed to maintain a scheduled engine idle speed.

The need for a controlled transition to the idle speed control mode when the vehicle operator releases the throttle has long been recognized. For example, to prevent the engine speed from undershooting the idle speed, thereby giving rise to potential engine stalling, or to prevent the increase in hydrocarbon emissions resulting from a deficiency of air, it has been suggested that the released throttle position be established at some controlled transitional throttle angle.

The U.S. Pat. No. 4,848,189 to Simon, Jr. et al discloses such a control system which is directed to an additional function for controlling the throttle position when the throttle is released by the vehicle operator so as to provide for smooth transmission upshifts and a smooth transition to the engine coastdown operation.

To execute the control schemes requiring adjustment of the throttle stop, an electrical motor including a gearset, called herein an idle speed control (ISC) motor, is used to position the stop. Electrical pulses actuate the motor to retract or extend the stop and thereby set the minimum throttle angle. If the motor has a predictable response to the actuating pulses, the motor can be displaced a desired amount according to the pulse width of the actuating pulse to obtain accurate control. Due to manufacturing tolerances, the ISC motors do not all have the same characteristics and thus each vehicle will respond differently to identical control inputs. This condition forces the design to include tradeoffs of response time versus overshoot and undershoot. It is desired therefore to eliminate the system variability due to motor to motor variations so that a consistent system response can be expected.

Another throttle control scheme which requires a motor with a predictable response is an electronic throttle control (also called a drive by wire system) wherein there is no mechanical connection between the accelerator pedal and the throttle. Rather, the throttle blade is positioned solely by a motor which is controlled by the control unit to carry out the throttle response to accelerator pedal input as well as to implement the idle speed control. It is likewise desired for the electronic throttle control system to eliminate system variability due to motor to motor variations so that a consistent system response can be expected.

SUMMARY OF THE INVENTION

It is therefore an object of the invention to provide a method of accommodating a throttle motor control system to eliminate the effects of motor variability. It is another object to teach the control system the characteristics of the motor so that appropriate control pulses can be delivered to the motor for the desired motor response.

The invention is carried out in a motor vehicle having an internal combustion engine with an induction passage and a throttle valve for controlling airflow through the induction passage into the engine, a throttle position sensor and a throttle control motor for controlling the position of the throttle valve by the method of learning the gain of the throttle control motor comprising the steps of: positioning the motor in a start position with the throttle valve position subject to the motor position, applying a set number of energizing pulses of set pulse width to the motor to effect motor and throttle valve displacement, determining the amount of throttle valve displacement, and calculating a gain factor for the motor from the amount of throttle displacement relative to a standard displacement. This process is repeated for several pulse width sizes to fully characterize the throttle motor.

BRIEF DESCRIPTION OF THE DRAWINGS

The above and other advantages of the invention will become more apparent from the following description taken in conjunction with the accompanying drawings wherein like references refer to like parts and wherein:

FIGS. 5 and 6*a*–6*d* are flow charts illustrating a computer program used in by the control unit of FIG. 1 in carrying out the invention.

DESCRIPTION OF THE INVENTION

Figure 1:
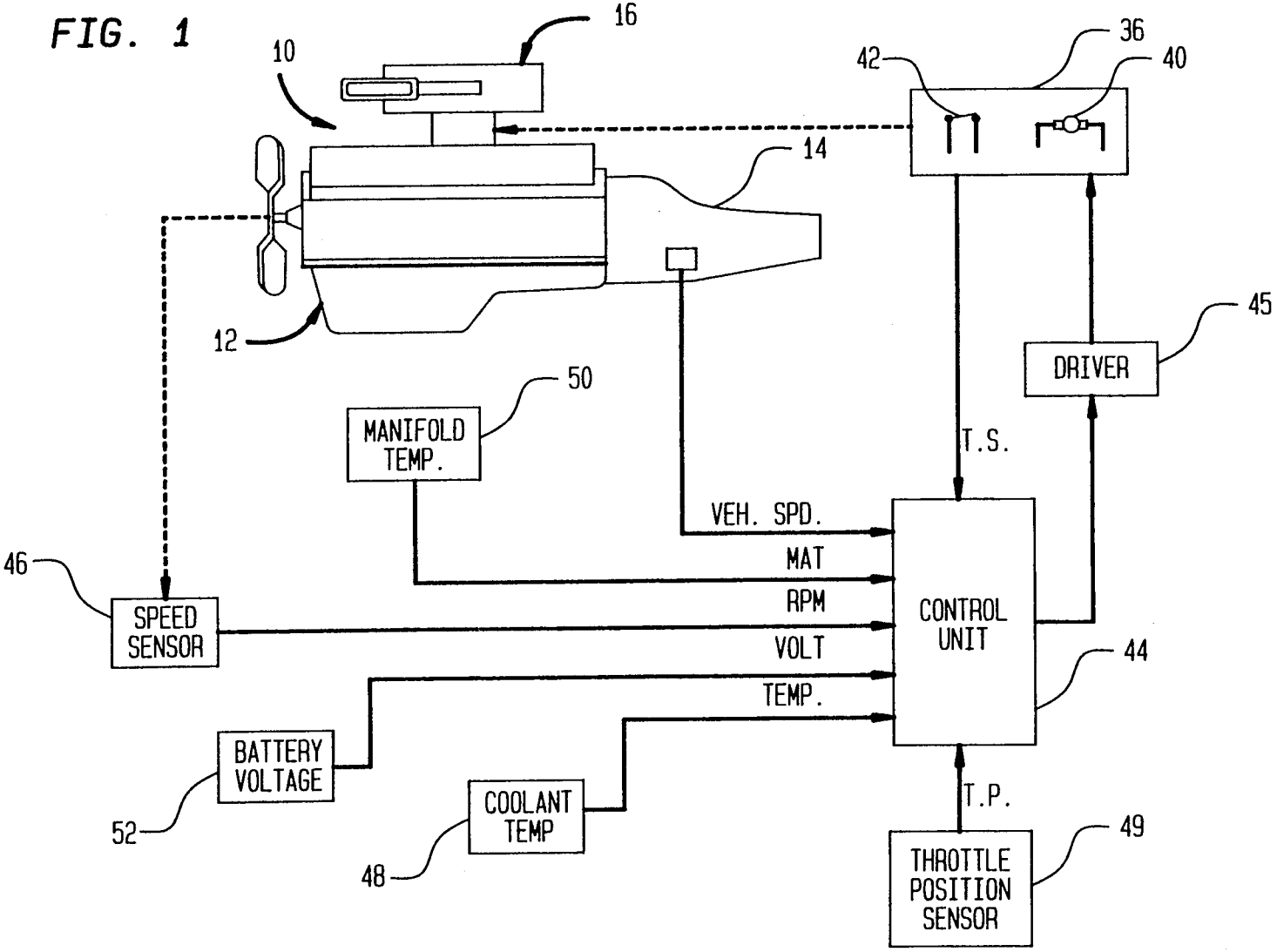
FIG. 1 is a schematic and block diagram of a motor vehicle engine and a control system including a computer based control unit for idle speed control and for carrying out the learning function of the invention.

Referring to the drawings, and more particularly to FIG. 1, reference numeral 10 generally designates a motor vehicle drive train including an internal combustion engine 12 and an automatic transmission 14. The engine includes a crankshaft whose output drives the transmission 14, the output of which drives the vehicle wheels (not shown). The engine 12 is supplied with an air-fuel delivery system 16 of the type wherein a throttle in an induction passage controls the flow of air therethrough and additional apparatus supplies fuel sufficient to achieve a desired air/fuel ratio of the mixture drawn into the engine 12 for combustion.

Figure 2:
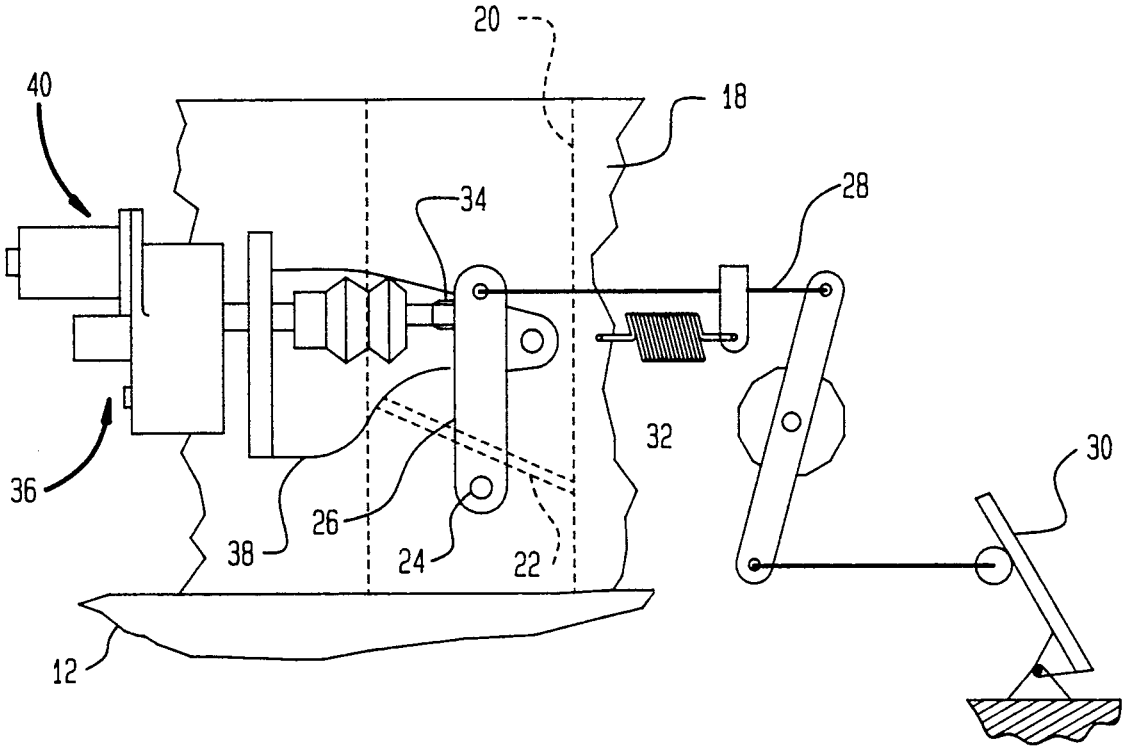
FIG. 2 is an elevational view of a throttle stop control device utilized in the control system of FIG. 1.

The air flow control apparatus is more specifically illustrated in FIG. 2. The engine 12, of which only a top portion is shown, includes a throttle body 18 with a throttle bore 20 in which a throttle valve 22 is pivotally mounted by a shaft 24. The throttle valve shaft 24 has a lever 26 fixed thereto which is operably connected by linkage 28 to an accelerator pedal 30 located in the vehicle's passenger compartment. The throttle valve 22 is normally opened by the vehicle operator depressing the accelerator pedal 30. When the operator releases control of the throttle valve 22, the throttle lever 26 is returned and held by a return spring 32 against a throttle stop 34 on a throttle stop positioner 36 which is mounted by a bracket 38 on the throttle body 18. The throttle stop positioner 36 is controlled to adjust the position of the throttle stop 34 thereby controlling the minimum open position of the throttle valve 22 and thus the engine's idle speed when the operator releases the accelerator pedal 30. The throttle stop positioner is also controlled to establish the position of the throttle stop 34 for controlling the transition to the idle speed control mode of the engine 12 when the accelerator pedal 30 is released by the vehicle operator.

The throttle stop positioner 36 includes a direct current permanent magnet motor 40 whose output shaft is coupled to a gear train such that upon rotation of the motor output shaft, the throttle stop 34 is caused to extend or retract depending upon the direction of rotation of the output shaft of the motor 40. By selective operation of the motor 40, the position of the stop 34 is controlled to define the released position of the throttle valve 22 in the throttle bore 20. The throttle stop positioner 36 also includes a throttle stop switch 42 (schematically illustrated in FIG. 1) that is closed by a slight movement of the throttle stop 34 when engaged by the throttle lever 26. The closed switch then indicates a released throttle condition. The specific form of the throttle stop positioner 36 including the switch 42 operated upon release of the throttle valve 22 may take any desired form including by way of example the form as illustrated in the U.S. Pat. No. 4,212,272 which is assigned to the assignee of this invention.

Returning to FIG. 1, a control unit 44 responds to various input signals and controls the DC motor 40 for establishing a desired engine idle speed and for establishing the transition to the idle speed control mode upon release of the vehicle throttle by the vehicle operator. The DC motor 40 is controlled by the control unit 44 via a driver circuit 45 to establish the desired position of the throttle stop 34. The driver circuit 45 may take the form of a conventional H-switch that is responsive to a signal representing a commanded direction of the motor 40 and a control signal for driving the motor in the specified direction.

To establish the desired position of the throttle stop 34, input signals indicative of various operating parameters are supplied to the control unit 44. One such signal is a signal representing vehicle speed provided by a speed transducer in the transmission 14. Alternatively, a wheel speed signal may be utilized. Engine speed is provided by a speed sensor 46 which may be any appropriate sensor of the type adapted to generate a signal indicative of the rotational speed of the crankshaft. Examples of such a sensor are an electromagnetic pickup adjacent the toothed flywheel of the engine 12 coupled to an input counter of the control unit 44 or the reference pulse output of a spark control circuit providing a reference pulse at predetermined engine rotational increments. The control unit 44 also receives analog signals from an engine coolant temperature sensor 48, a throttle position signal from a position sensor 49 such as a throttle driven potentiometer, an intake manifold air temperature sensor 50 and a battery voltage signal from the vehicle battery 52. In addition, the output of the throttle stop switch 42 in the throttle stop positioner 36 is provided to the control unit 44 to provide a signal indicative of a released or non-released condition of the throttle blade 22.

Figure 3:
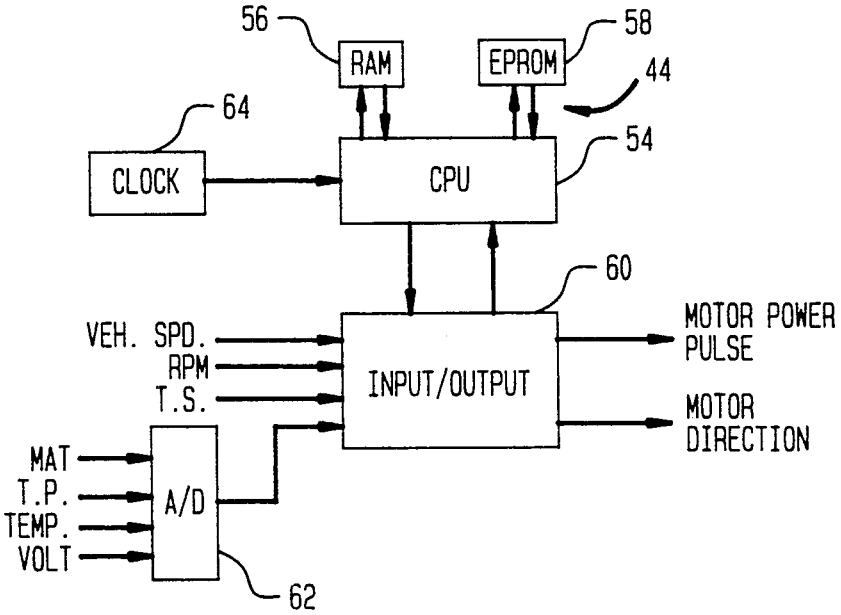
FIG. 3 illustrates a vehicle mounted computer which is a preferred form of the control unit of FIG. 1, FIGS. 4*a* and 4*b* are graphs of motor pulses and throttle angle, respectively, during the learning process of the invention.

In its preferred form, the control unit is computer based and may take the form of any well known digital computer based controller. FIG. 3 illustrates one possible form of the control unit 44. The control unit basically comprises a central processing unit (CPU) 54 which interfaces in the normal manner with a random access memory (RAM) 56, an electrically programmable read only memory (EPROM) 58, an input/output unit (I/O) 60, an analog-to digital converter (A/D) 62 and a clock 64.

In general, the CPU 54 executes an operating program stored in the EPROM 58 which also contains constants and values stored such as in lookup tables addressed in accord with the values of selected parameters. Data is temporarily stored and retrieved from various EPROM designated address locations in the RAM 56. At least a portion of the RAM is designed as a "keep-alive" memory which is powered even when the ignition is turned off and thus retains data as long as battery voltage is available in the vehicle, but the data is lost when the battery is disconnected. The output of the speed sensor 46, the throttle stop switch 42 and the vehicle speed signal from the transmission 14 are supplied to the input/output circuit 60. The analog signals from the coolant temperature sensor 48, the throttle position sensor 49, the manifold air temperature sensor 50 and the battery voltage are processed by the A/D 62, the output of which is provided to the input/output circuit 60.

The input/output circuit 60 provides for a discrete output to the motor driver 45 to establish the direction of operation of the DC motor 40 and a pulse output to the motor driver 45 to cause the DC motor 40 to position the throttle stop 34. While the input/output circuit 60 may take any form, the circuit may provide a controlled pulse output by initiating the pulse and inserting into a register a number representing the point in time as measured by a free running counter clocked by the clock 64 for terminating the pulse. When the free running counter becomes equal to the count in the register, the pulse is terminated.

The programs in the computer which determine the desired position of the throttle stop rely on the motor responding to the pulses in a predictable manner so that for a given pulse width a known change of throttle angle will occur. In particular, the programs calculate pulse widths for a standard or nominal motor response, that is, for a motor having ideal characteristics. Because of difficulty in producing motors which all meet the ideal specification, it is desirable to learn the characteristics of each motor and modify the normal calculated pulse to achieve the expected result. Then motors falling within a range of specified characteristics can be used and accurate operation will be obtained.

A gain factor learn program is run each time the vehicle ignition is turned off, provided the engine is warm. The program is provided to learn the motor gain relative to a standard motor in nominal operation conditions and to retain the gain information in the keep-alive memory. The gain of a motor varies for different pulse widths. It has been found that three measured gain factors at different pulse widths are sufficient to describe the motor gain. If for a given pulse width, the motor causes the same throttle displacement as the standard motor, the gain factor is said to be one. On the other hand, if the motor causes less than the standard displacement, the gain factor is greater than one and the calculated pulse width will be multiplied by the gain factor to achieve the desired displacement. For example, if the tested motor moves the throttle blade 5 degrees and a nominal motor motor would move the throttle blade 2.5 degrees, the tested motor would have a gain two times the nominal motor. To make the tested motor act like the nominal motor, one half of the normal pulse width would have to be issued. The learned gain factor is then 0.5. Limits, for example zero and two, are placed on the learned gain factor. If the computed gain factor is outside of the limits, previously defined diagnostic actions are activated. The response of an idle speed motor depends upon battery voltage and motor temperature. To normalize the measured gain, battery voltage compensation and temperature compensation values are applied. The manifold air temperature is used as an approximate value of the motor temperature. The system voltage and manifold temperature at the time of ignition turnoff are used in determining the compensation. The compensation values are empirically determined by calibrating a nominal motor at many voltages and temperatures, and the values are stored in lookup tables for retrieval when needed.

Figures 4A, 4B:
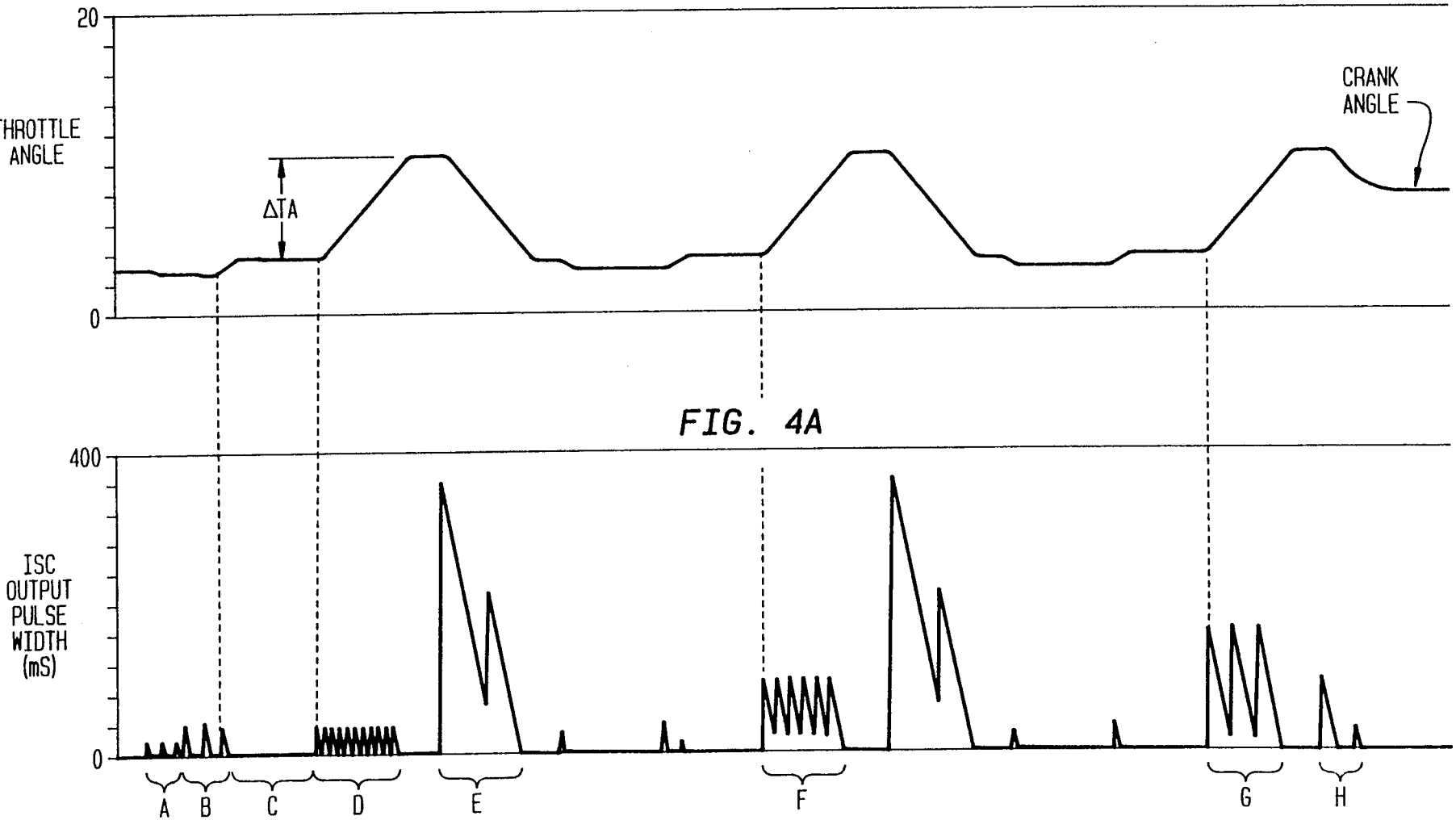

FIGS. 4*a* and 4*b* show the applied motor actuation pulses and the throttle angle during the gain factor learn process. For this example, the program is first run with eleven 50 ms pulses with 37 ms pauses between pulses, then run a second time with six 110 ms pulses and 75 ms pauses and a third time with three 180 ms pulses and 150 ms pauses. Each of these groups of pulses produces a change in throttle angle of about 8 degrees. The gain factor measurement is made with several pulses rather than just one in order to minimize the overall error in throttle angle measurement. The maximum travel of the motor limits the number of pulses that can be used. The pauses between pulses are used to simulate normal operating conditions and thus improve measurement accuracy. In normal use the motor is pulsed once and is allowed to come to a rest. The pause after each pulse allows the motor to stop before the next pulse issues.

Initially, the motor is either extended or retracted to an initial position of 2 or 3 degrees throttle angle by pulses A in FIG. 4*a*. Because the motor has a gear set driving the output, some gear lash may be present. To eliminate the effect of lash from the measurement of gain, the motor is extended to a point to "wind up" the motor (take up the lash) by pulses B. After a stabilization delay C, the throttle angle as indicated by the TPS is recorded as a start value. The motor is actuated by a given number of pulses D of a certain pulse width, and a stabilization delay after each pulse insures that the motor coasts to a complete stop before the next pulse is applied. The new throttle angle is measured and the change in angle or displacement (shown as Delta T.A. in FIG. 4*b*) is calculated. The gain learn factor is then Nominal Delta/[Measured Delta*TC*VC] where Nominal Delta is the displacement of a nominal motor, Measured Delta is the measured displacement, TC is temperature compensation, and VC is battery voltage compensation.

Beginning with motor retraction by pulses E, the process is repeated for the 110 ms pulses F and again for the 180 ms pulses G to thus obtain the learn gain factor for all three pulse widths and the factors are stored in the keep-alive memory. If a motor is found to be out of specification, a default gain factor of one is applied and the diagnostic data is stored. In order to prepare the engine for starting, the ISC motor is moved to crank position by pulses H and the program is terminated.

Figure 5:
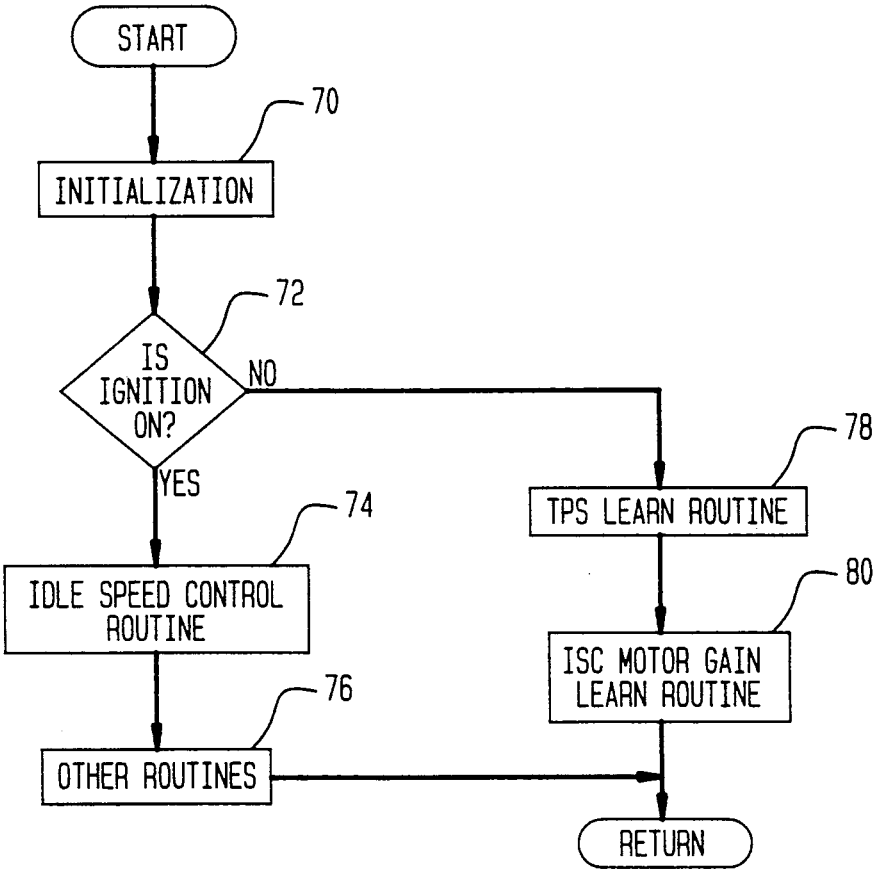
Figure 6A:
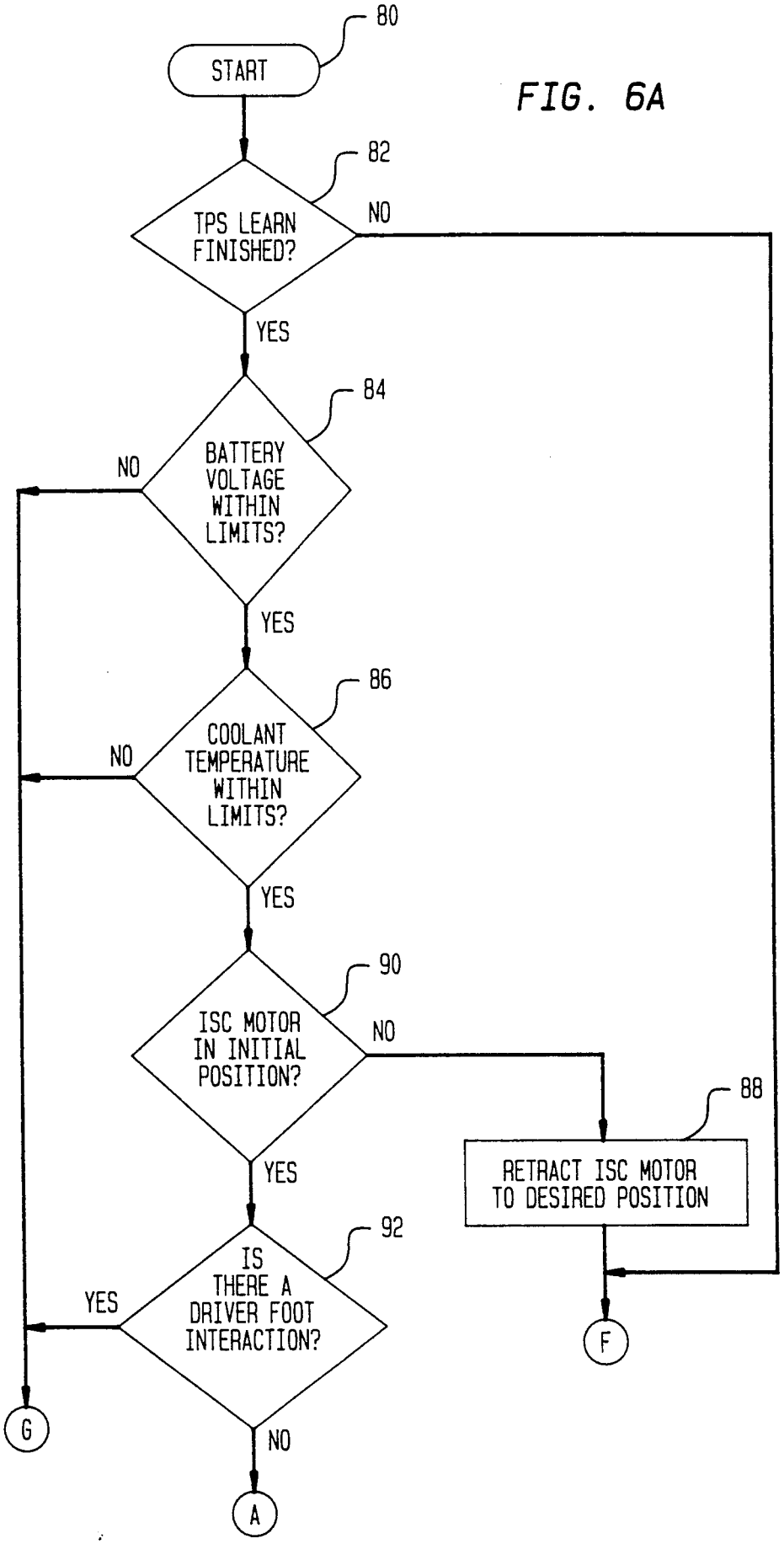
Figure 6B:
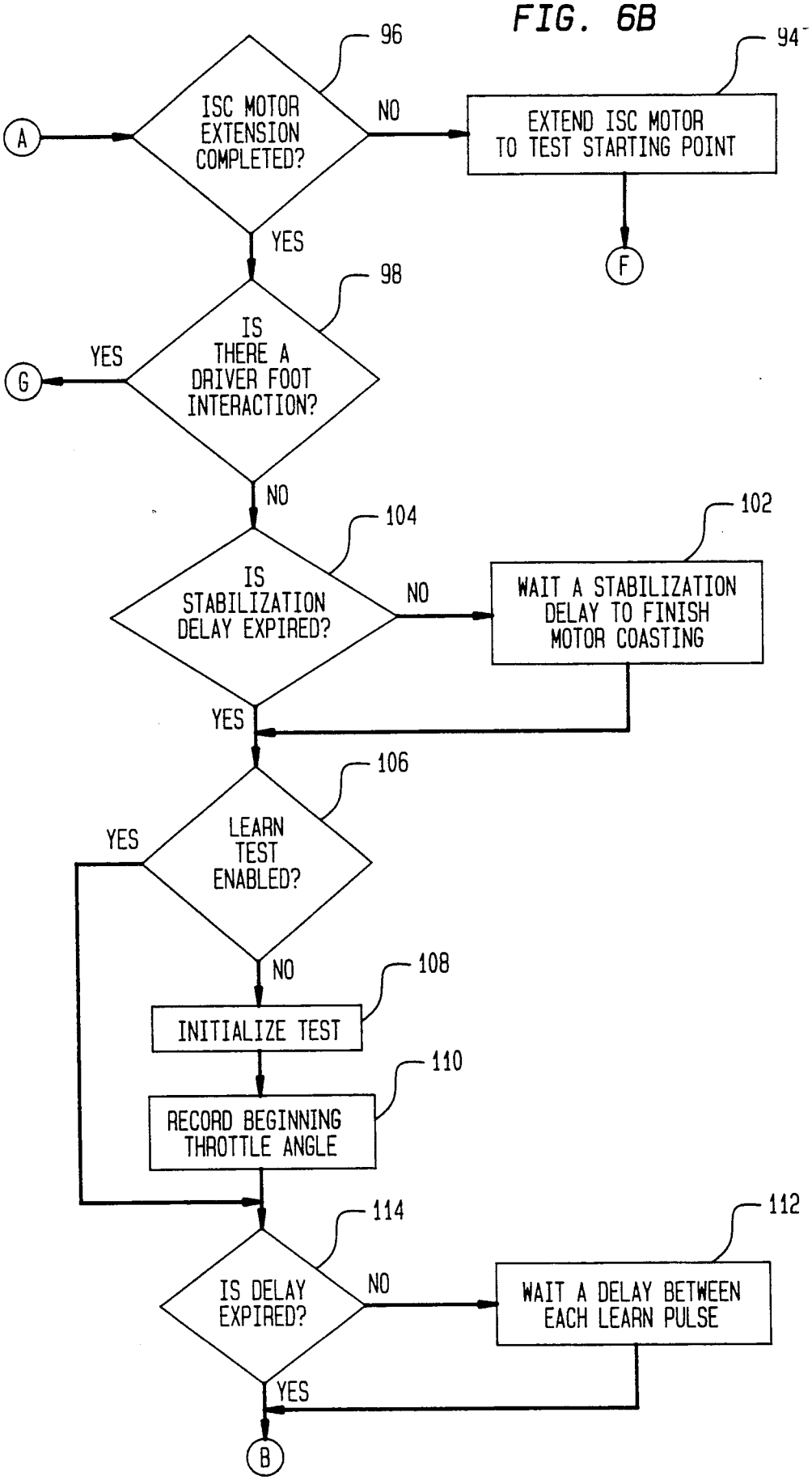
Figure 6D:
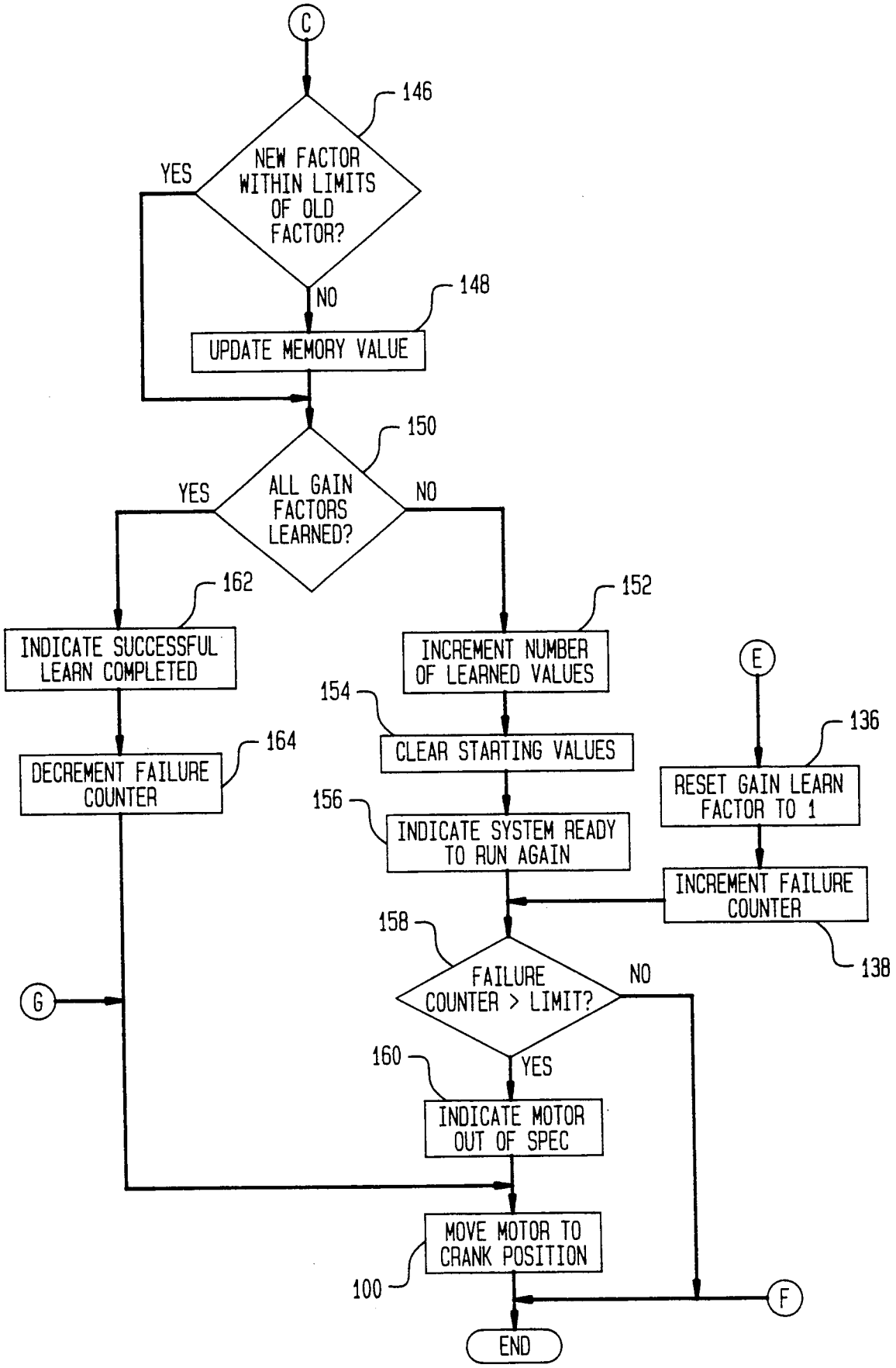

In the description of the flow charts of FIGS. 5 and 6, reference numerals enclosed in angle brackets <nn> refer to the functions defined in the blocks bearing the respective numerals. The executive program or main loop is shown in FIG. 5. The computer repetitively runs through the main loop from the time the ignition is turned on until the gain learn program is completed. The program is initialized <70> to set various registers and timers of the control unit 44 and to read measured values prior to the commencement of the control functions. If the ignition is on <72>, the idle speed control routine is run <74> as well as other routines <76>. The other routines include fuel control and spark timing, for example. If the ignition is turned off <72>, a TPS learn routine <78> and the ISC Motor Gain Learn routine <80> are run.

In FIGS. 6*a*–6*d*, the program for the motor gain learn routine 80 is enabled when the ignition is turned off and the TPS learn routine is finished <82>. The TPS learn routine 78 sets the throttle angle to its minimum position and reads the throttle position sensor 49 to establish the minimum value of throttle position data. Then if the battery voltage is within limits <84> and the engine coolant temperature is within limits <86>, the ISC motor is pulsed to retract or extend to its initial position <88>. This yields the pulses A of FIG. 4*a*. When the motor is in initial position <90>, there is a test for a driver foot interaction <92>. This is sensed by detecting an advancing TPS signal before a motor extension pulse is commanded, revealing that the accelerator pedal has been pressed down, or by detecting an open throttle switch indicating that the throttle is being held open. In the event of such an interaction the motor is set to the crank angle <100> (FIG. 6*d*) and the gain learn program is terminated.

If no driver's foot interaction is detected, the motor is commanded to extend to the starting point <94> (by pulses B) and when the extension is completed <96>, there is another test for driver interaction <98>. This is sensed by detecting a retracting throttle position signal or an open throttle switch. If there is no interaction a stabilization delay is begun <102> (delay C) and when the delay expires <104> the actual learn test is enabled. If the test has not already been enabled <106> the test is initialized by setting counters and registers <108> and the beginning throttle angle is recorded <110>. A delay between each pulse is accomplished by waiting a delay time <112> until the delay has expired <114>. A delay thus occurs prior to the first pulse as well. Then a check is made for the throttle switch closed state <116> as a driver interaction indicator and if it is closed it is determined whether the throttle angle is within the ISC authority range for the test <118>. That is, it will be assured that the motor travel required for the test is available. Then the number and size of the pulses for the current test is looked up in a table <120> and a pulse is issued <122>. When the pulse is completed there is a test for forward movement of the throttle <124>. If no forward movement occurs, the drivers foot is on the throttle or the ISC motor is inoperative and the learn process is aborted. When forward movement does occur, and if the pulses are not all delivered <126> the next pulse size is obtained <128> and the delay between pulses is reset <130>. Then the program continues in this vein to issue additional pulses. When all of the pulses for one test are delivered <126>, the new TPS signal is read and the change in throttle angle is calculated <132>. If the change is not within limits <134> the gain factor is reset to one <136> and a failure counter is incremented <138>. If the change is within limits <134> battery voltage compensation is applied <140>, temperature compensation is applied <142> and the gain factor is calculated <144>.

If the newly calculated factor is changed only a small amount from the old factor <146> the memory is not updated but if the change exceeds preset limits the memory is updated <148> by storing it in the keep-alive memory to replace the old value. If not all the three gain factors are learned <150>, the number of learned values is incremented <152>; this number is used in block 120 to address the lookup table for the size and number of pulses. Starting values such as the beginning throttle angle value and certain flags are cleared <154> and an indication is given that the system is ready to run again to measure the next gain factor <156>. If the failure counter has reached a limit value <158>, a flag is set for a diagnostic program to indicate that the motor does not meet specifications <160>. This stores information about the motor for use when diagnostic procedures are run on the engine. After such an indication, the motor is moved to the crank position <100> and the program terminated. If the failure counter is not at the limit <158> the program goes to the END and will repeat during the next main loop. When all the gain factors are learned <150> a successful learn is indicated <162>, the failure counter is decremented <164> and the motor is moved to crank position <100>. It is thus apparent that the number of successful learns is balanced against the failures to determine whether a motor is out of specification.

The learned gain factor is thus renewed each time the ignition is turned off if the engine is warm. This enables calibrating the system when the vehicle is new, restoring the gain factor in the event battery voltage is removed and the keep-alive memory is lost, as well as updating the gain factor which may change due to aging. The usual engine control computer is used and no new inputs are required, so that the only change is in the computer program. Since the program runs when the engine is off, there is no interference with engine operation or with the running of other routines.

Figure 7:
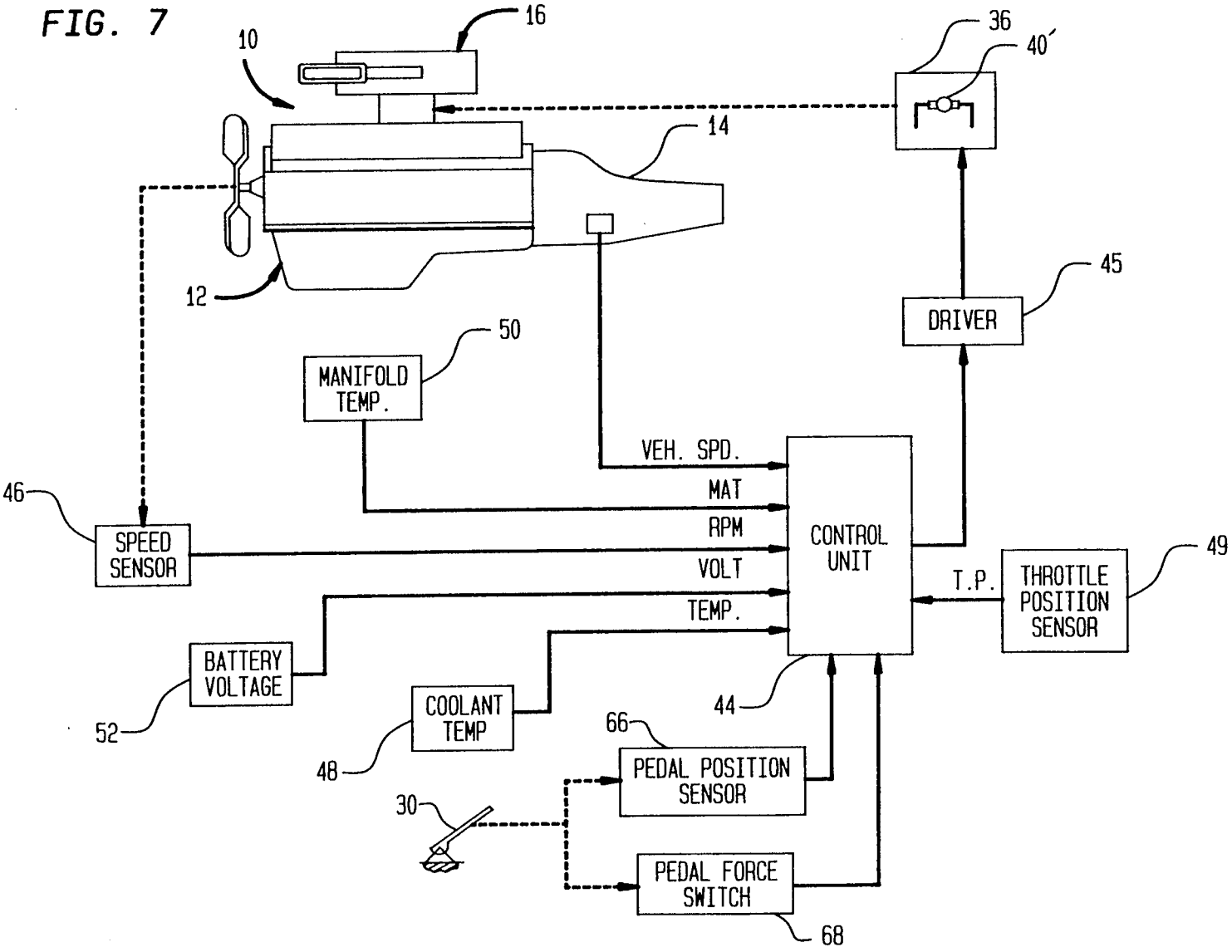
FIG. 7 is a schematic and block diagram of a motor vehicle engine and a control system including a computer based control unit for throttle control and for carrying out the learning function according to another application of the invention.

In an electronic throttle control system, the throttle switch 42 is not present. As shown in FIG. 7, the accelerator pedal 30 is coupled to a pedal position sensor 66 and to a pedal force sensor 6B. The throttle motor 40' is directly connected to the throttle for controlling throttle position. The control unit 44 is programmed to drive the motor 40' to the throttle position corresponding to the pedal position sensor, subject to overriding controls such as idle speed control. Otherwise, the drive by wire system is much the same as that described relative to FIG. 1. The pedal force sensor 68 determines whether the operator's foot is on the pedal 30, and thus takes the place of the throttle switch 42. With that substitution, the above described method fully applies to learning the gain of a throttle motor in the electronic throttle control system.

The term "throttle control motor" as used herein includes the throttle motor in an electronic throttle control system as well as an idle speed control motor.

We claim:

1. In a motor vehicle having an internal combustion engine with an induction passage and a throttle valve for controlling airflow through the induction passage into the engine, a throttle position sensor and a throttle control motor for controlling the position of the throttle valve, the method of learning the gain of the throttle control motor comprising the steps of:

positioning the motor in a start position with the throttle valve position subject to the motor position, applying a set number of energizing pulses of set pulse width to the motor to effect motor and throttle valve displacement, determining the amount of throttle valve displacement, and calculating a gain factor for the motor from the amount of throttle displacement relative to a standard displacement.

2. The invention as defined in claim 1 including repeating the steps of claim 1 for a different pulse width to learn an additional gain factor for the motor.

3. The invention as defined in claim 1 including the steps of calibrating the effect of temperature on motor displacement, sensing a temperature approximating the temperature of the motor, and compensating the gain factor for the effect of the sensed temperature.

4. The invention as defined in claim 1 including the steps of:

calibrating the effect of battery voltage on motor displacement, sensing the vehicle battery voltage, and compensating the gain factor for the effect of the sensed battery voltage.

5. The invention as defined in claim 1 including the step of delaying after each pulse to allow the motor to coast to a stop before applying a subsequent pulse.

6. The invention as defined in claim 1 wherein the step of determining the amount of throttle displacement comprises the step of:

sensing the throttle position at the start position and after displacement and calculating the difference.

7. The invention as defined in claim 1 including the steps of:

empirically determining temperature and voltage compensation tables reflecting the effects of temperature and voltage on motor displacement, and sensing battery voltage and an approximate motor temperature, wherein the step of calculating a gain factor comprises dividing a standard displacement by the product of throttle displacement, the temperature compensation and the voltage compensation.

8. The invention as defined in claim 1 wherein the method of learning the gain is initiated by turning off the vehicle ignition voltage.

9. The invention as defined in claim 1 wherein the motor is subject to lash, wherein the energizing pulses extend the motor in throttle opening direction and wherein the step of positioning the motor in start position comprises the steps of: commanding the motor to move to a position below the start position, and then extending the motor to start position, thereby removing lash from the motor.

10. In a motor vehicle having an internal combustion engine with an induction passage and an angularly rotatable throttle valve for controlling airflow through the induction passage into the engine, a throttle position sensor and an idle speed control motor for limiting the position of the throttle valve in the closing direction, the method of learning the gain of the idle speed control motor comprising the steps of:

initiating learning the gain when ignition voltage is removed, moving the motor to a start position by extending the motor in the throttle opening direction with the throttle valve angle subject to the motor position, sensing the throttle angle at the start position, applying a set number of energizing pulses of set pulse width to the motor to effect motor and throttle valve displacement in the throttle opening direction to a final position, pausing for a delay time between successive pulses to allow the motor to coast to a stop, sensing the throttle angles at the start and final positions and determining the amount of throttle valve displacement, and calculating a gain factor for the motor from the amount of throttle displacement relative to a standard displacement.

11. The invention as defined in claim 10 including the steps of:

empirically determining temperature and voltage compensation tables reflecting the effects of temperature and voltage on motor displacement, and sensing battery voltage and an approximate motor temperature, looking up voltage and temperature compensation values for the measured voltage and temperature, wherein the step of calculating a gain factor comprises dividing a standard displacement by the product of throttle displacement, the temperature compensation and the voltage compensation.

12. The invention as defined in claim 10 wherein the motor gain varies according to the energizing pulse width and wherein the steps of the method are repeated for other pulse widths to obtain other gain factors.

* * * * *